US006711882B1

(12) United States Patent
Schneider et al.

(10) Patent No.: US 6,711,882 B1
(45) Date of Patent: Mar. 30, 2004

(54) DEVICE FOR PRODUCING AND WITHDRAWING STACKS OF PLASTIC BAGS, ESPECIALLY BAGS FOR AUTOMATIC MACHINES

(75) Inventors: Jakob Schneider, Niederkassel (DE); Oliver Englert, Bad Honnef (DE); Heiko Knoll, Neuss (DE); Hans Bert Wuits, Troisdorf (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/763,715

(22) PCT Filed: Jul. 28, 1999

(86) PCT No.: PCT/EP99/05401

§ 371 (c)(1),
(2), (4) Date: Feb. 23, 2001

(87) PCT Pub. No.: WO00/12300

PCT Pub. Date: Mar. 9, 2000

(30) Foreign Application Priority Data

Mar. 24, 1998 (DE) ..... 199 13 255
Aug. 28, 1998 (DE) ..... 198 39 144

(51) Int. Cl.[7] ..... B65B 35/50
(52) U.S. Cl. ..... 53/541; 53/241
(58) Field of Search ..... 53/540, 53, 581, 53/593, 219, 241, 249, 265; 493/204; 198/692

(56) References Cited

U.S. PATENT DOCUMENTS 3,714,759 A * 2/1973 Pagdin et al. ..... 53/508
3,797,195 A * 3/1974 Brink et al. ..... 53/471
4,643,027 A * 2/1987 Deutsch et al. ..... 73/865.8
5,040,353 A * 8/1991 Evans et al. ..... 53/54
5,042,862 A 8/1991 Tübke
5,056,202 A * 10/1991 Stiegler ..... 29/33 P
5,069,016 A * 12/1991 Grossi ..... 53/398
5,101,609 A * 4/1992 Cook ..... 53/53
5,403,056 A * 4/1995 Wallace ..... 294/98.1
5,608,818 A * 3/1997 Chini et al. ..... 382/153
5,626,000 A * 5/1997 Edwards et al. ..... 53/281
5,655,355 A * 8/1997 Ramler ..... 53/475
5,934,049 A * 8/1999 Cerf ..... 53/553
6,006,946 A * 12/1999 Williams et al. ..... 221/9
6,319,182 B1 * 11/2001 Schneider ..... 493/10

FOREIGN PATENT DOCUMENTS

DE 38 34 115 C1 5/1990

* cited by examiner

*Primary Examiner*—Rinaldi I. Rada
*Assistant Examiner*—John Paradiso
(74) *Attorney, Agent, or Firm*—Herbert Dubno

(57) ABSTRACT

The invention relates to a device for producing and withdrawing stacks of plastic bags, especially bags for automatic machines, in coordination with a gradually moving pin stack chain (4) from which the bag packages (6) are removed in a simplified and accelerated manner with the aid of a robot (16) that has a multifunctional hand (17) and automatically executes all essential manipulations and/or movements required for the formation and piling of the bag stacks and finally delivers them to an unloading station (62).

11 Claims, 11 Drawing Sheets

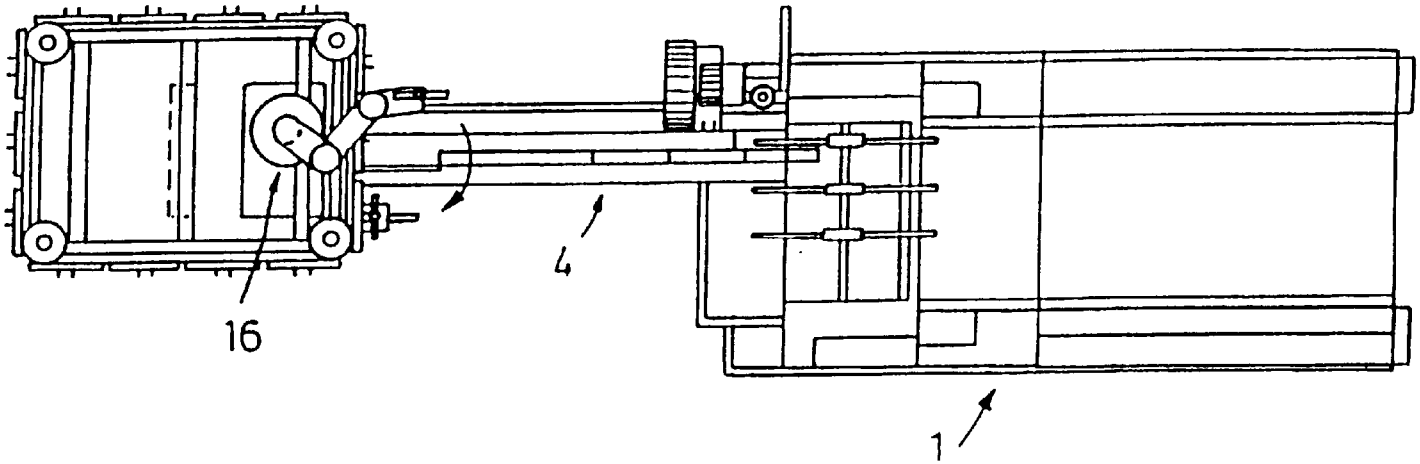
Fig. 8
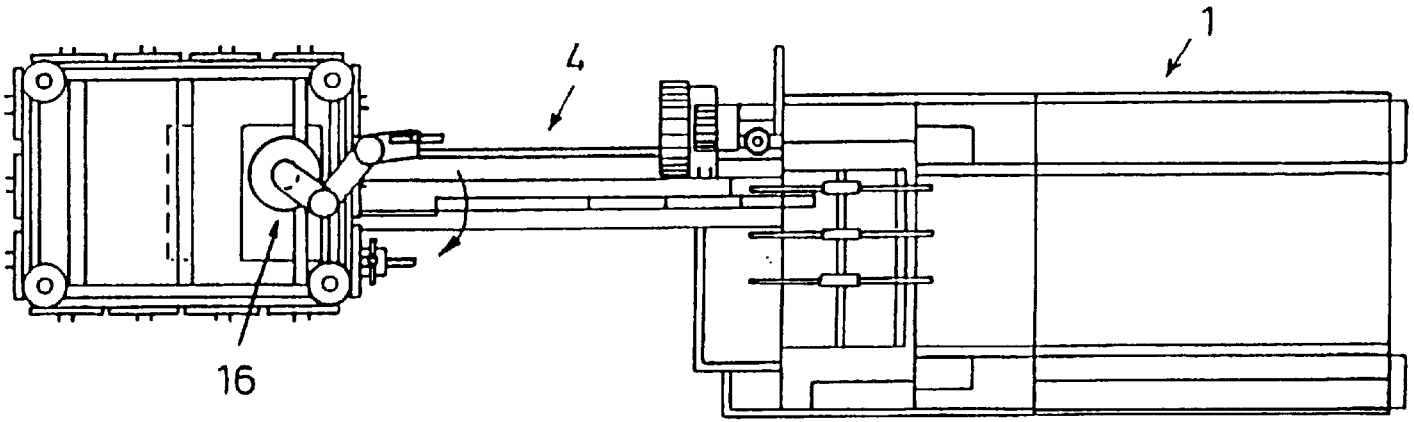

1
4
5
5'
6
10
13
14
15
16
17
18
19
21
23
33
34
69
80
81
82
83
84
85
86
87
88
89
90
91
92
93

DEVICE FOR PRODUCING AND WITHDRAWING STACKS OF PLASTIC BAGS, ESPECIALLY BAGS FOR AUTOMATIC MACHINES

TECHNICAL FIELD

The invention relates to a device for producing and delivering of stacks of plastic bags, particularly bags for automated machines, with a crosscut-welding station for making welding seams in a double-layer foil web of plastic material and separating the plastic bags from the web of plastic material, optionally with a stamping station for producing stacking holes and an interlocking station, as well as a pin stacking conveyor with a stepwise movable pin stacking chain and a discharge station which has a robot with a grip hand.

STATE OF THE ART

One problem with all bag-producing machines with a subsequently arranged collection and stacking device consists in that the output of the stacking, respectively collection device has to be adjusted to the continuously working bag fusion machine so that no interruption of the cycle occurs, while a finished bag is removed from the stacking station and an empty stacking mechanism is introduced in the stacking station. In the production of the bag stacks it is known to fix the same by means of wire brackets. For this purpose either the bag stack is lifted from the stacking pins of the pin stacking conveyor and with the now loosely superimposed bags pushed over the legs of the wire brackets, or the legs of the wire brackets are inserted in slot-like recesses of the stacking pins of the pin stacking device, removing the bag stacks this way. Subsequently the bag stack has to be secured by safety plates, respectively rubber stoppers arranged on the bracket legs. Sometimes the separate bag stacks are covered on both sides with paper strips, respectively intermediate paper layers. The manual removal of the bag stacks and the insertion of the wire brackets represents a comparatively big physical effort for the operator, since the same, repetitive motions have to be performed in a very short time, because of the relatively high production speed.

To the extent that the use of wire brackets for holding the individual bags in the bag stack should be eliminated, an interlocking of the individual plastic bags to a bag stack can already be achieved in the pin stacking conveyor, in that the bags are fused together by heat in defined locations, for instance in an area defined by perforations. This way a considerable simplification in the production of the plastic bags is reached, since the removal of the bag stacks from the pin stacking conveyor can be performed much easier and finally also the packaging of the bags in cardboard boxes or the like is also simplified. However it still remains the obligation of the operator to examine the quality of the bag packages and to prepare them for packaging for instance in cardboard boxes.

From DE 38 34 115 can be seen that the concept of an automated removal process in the removal station by means of a robot is not new. However in the end at that time it was considered much too complicated and expensive to be put to use.

Indeed from EP 0 384 281 A1 a device for stacking bags on wire brackets has been known, whereby the stacking device has stepwise movable stacking plates, onto which the bags can be stacked by means of wire brackets. The positioning of the wire brackets on the stacking plates is done by means of an automatically controlled and driven robot with a grip hand. An obvious additionally arranged robot with grip hand can furthermore remove from the stacking plate the stacks interlocked by wire brackets and rubber stoppers and depose them on a transport belt.

DESCRIPTION OF THE INVENTION

It is the object of the invention to create a device of the mentioned kind suitable for producing and delivering stacks of plastic bags, particularly bags for automated machines, which further simplifies the and accelerates especially the removal and transfer of the bag stacks, so that an operator can limit his function only to the remaining quality control of the bag stack at an easily accessible location of the machine.

According to the invention this object is achieved in that the robot, which can be controlled in accordance with the relative motion of the pin stacking chain of the pin stacking conveyor, is equipped with a multifunctional program-controlled hand, and is positioned at the end of the pin stacking conveyor in such a manner that basically all the handling and motion operations required for the formation and delivery of the bag stacks can be performed. Thereby it is important for the stationarily mounted robot that the relative motion of the pin stacking chain be overlapped in longitudinal direction, and for the compensation of web vibrations also in transverse direction. With the means of the invention it is insured that the operator has only to take care of quality control, after which the finished bag packages can be packaged by the robot in for instance a cardboard box. Since the entire process of stack formation and delivery is performed by a single robot, the motions performed by the robot can be easily monitored by an operator, so that even at high production speeds, one operator—depending on the type of bag—can also service, respectively supervise several machines under certain conditions.

This applies especially when the robot is substantially centrally located with respect to the longitudinal extent of the pin stacking conveyor and/or the robot is stationarily mounted in a support frame arranged behind the pin stacking conveyor above the circulation plane of the pin stacking chain. Preferably the support frame can also be designed for receiving the auxiliary means for the stack formation, such as wire brackets, safety plates, intermediate paper layers or the like and/or rotatably driven bracket supply device and/or a unit having a locking and correcting function.

All the devices required for the bag stack formation and delivery can be simply and safely fastened to the multifunctional hand, which has a first clamping bar and a second clamping bar adjustable in relation to the first, when the multifunctional hand has a mounting plate made of sandwich aluminum and a crossbeam adjustably guided in guide bars fastened to the mounting plates, which at the same time is designed to be the support of the upper clamping bar. Furthermore the mounting plate can be used for the mounting of auxiliary devices, such as holding device working with negative pressure for the safety plates, as well as intermediate paper layers and the like. Thereby the holding device for the safety plates can be designed as a suction :head and the holding device for the intermediate paper layers can be designed as a suction funnel.

For special purposes on the frontal side of the multifunctional hand wire bracket holders can be provided, by means of which wire brackets with bag packages are supplied to several machines arranged in a sequence on a common transport delivery belt, preferably designed as an elevated transport chain. In this case the brackets can be picked up from a bracket magazine by means of a straightening and feeding tong and transferred to the multifunctional hand of the robot.

To the extent that an interlocking of the bags by means of wire brackets and safety plates can be dispensed with, by means of the robot-controlled multifunctional hand, mounted according to the invention, it is possible to remove bag stacks interlocked through fusion from the pin stacking conveyor and to deliver them to a cardboard box or the like within a boxing station.

A further embodiment of the invention provides a collection device with a driving belt driven in a timed revolving manner which is arranged in the discharge station within the motion range of the robot, on which spaced-apart stacking plates each with a holding elements are fastened. Suitably it is further provided that the driving belt be guided about guide rollers which preferably arranged at a right angle to each other, at least one of the rollers being rotatably driven, and that further on the side facing the pin stacking conveyor, a filling station and on frontal side substantially transversely thereto a control and/or service station, as well as removal station on the side opposite to the driving belt are arranged.

The servicing is further simplified due to the fact that the stacking plates are fastened in an uneven number on the driving belt designed as a revolving chain and the latter are movable in a double timed step along the individual stations. In concrete execution a preparation of the stacking plates takes place starting from a bag stack receiving position in the filling station in a single timed step in a following start position, whereby in the holding element of the stacking plate a wire bracket, as well as optionally an inner intermediate layer, for instance in the form of a paper strip or a cardboard sheet, can be suspended in the wire bracket.

Further in a finishing position following the start position, which can also serve for control, optionally an outer intermediary layer and a rubber stopper or the like are slipped onto the legs of the wire bracket, The intermediate layers, as well as the rubber stoppers can be applied manually or in a suitable automated manner by the robot.

This way alternately a prepared stacking plate and a finished stacking plate are moved in a double timed step by means of the revolving chain into a bag stack removal position assigned to the removal station, whereby each time the finished bag stack can be seized by the grip arm of the robot which removes the bag stacks from the pin stacking conveyor and can be deposited in a packaging unit.

BRIEF DESCRIPTION OF THE DRAWING

Preferred embodiment examples of the invention are represented in the drawing and subsequently closer explained. The drawing shows.

WAYS TO IMPLEMENT THE INVENTION

Figure 1:
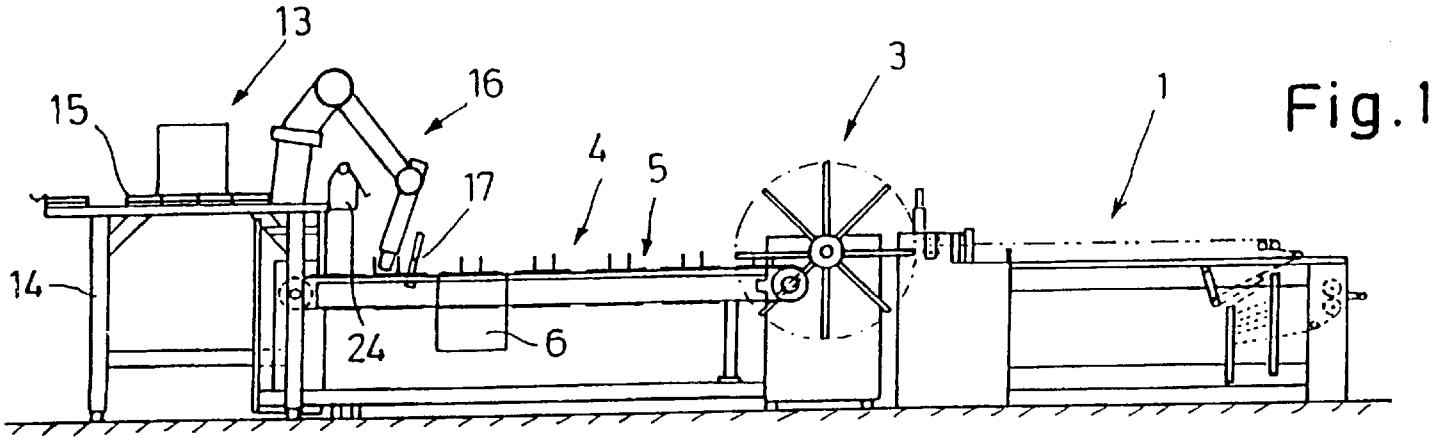
FIG. 1 a side view of a bag-producing machine with a pin stacking conveyor and a robot with a multifunctional hand, FIG. 2 a top view of the machine shown in FIG. 1, FIG. 3 a perspective representation of a single plastic bag, FIG. 4 a corresponding representation of a bag stack consisting of several plastic bags, FIG. 5 a side view of a locking and straightening unit, FIG. 6 the thereto pertaining top view, FIG. 7 the locking and straightening unit in cooperation with a bracket-feeding plate, FIG. 8 a top view of two identical machines arranged next to each other, FIG. 9 a top view of machines designed to be the mirror image of each other and arranged next to each other, FIG. 10 a frontal view of a multifunctional hand of the robot, FIG. 11 the thereto pertaining side view, FIG. 12 a top view on the multifunctional hand, FIG. 13 a part of the multifunctional hand, FIG. 14 a part of the transfer device with a bracket magazine and a straightening and feeding tong between the multifunctional hand of the robot and the bracket magazine, FIG. 15 a top view on four machines arranged next to each other with a common transport belt designed as a an elevated transport chain, FIG. 16 the thereto pertaining frontal view, FIG. 17 a top view on a machine with the interlocking of the bag packages in the area of the pin stacking conveyor and discharge within the boxing station, FIG. 18 a plastic bag with interlocking locations produced by fusion, FIG. 19 a boxing station on an enlarged scale, FIG. 20 a part of a pin stacking conveyor with a collection device, FIG. 21 a cross section through a bag stack held together by a wire bracket on an enlarged scale.
Figure 4:
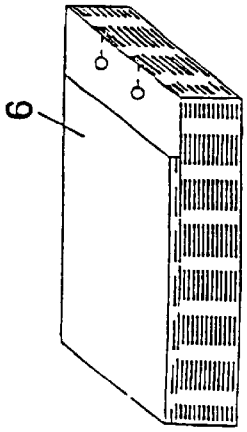
Figure 3:
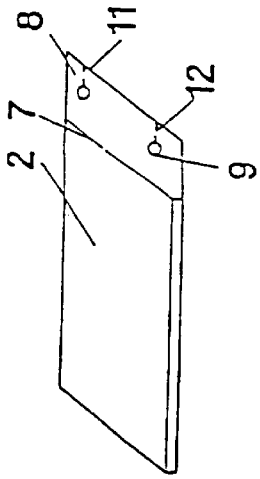

In FIG. 1 a bag-producing machine 1 is schematically represented, which is built and equipped for producing plastic bags, particularly so-called automatic plastic bags. From an unwinding stand not shown in the drawing a thermoplastic foil web, which can be for instance a tubular foil web, is unwound from a winding roll. Inside the bag-producing machine 1, the tubular foil web is guided over a not represented drive and tensioning rollers. By means of a hole-punching device also not shown in the drawing and a crosscutting-welding device, the bags 2 (FIG. 3) can be produced in a manner which is subsequently closer described. The crosscutting-welding device is followed by a transfer device 3, which in turn is followed by a pin stacking conveyor 4 with a stepwise revolving pin stacking chain 5. The individual plastic bags collected on the pin stacking conveyor can be collected to form package-like bag stacks 6, as indicated in FIG. 1. Such a bag stack 6 is closer illustrated in FIG. 4. Before we discuss this any further, in FIG. 3 it is shown that each individual plastic bag 2 as a so-called automatic bag has in the area of the filling opening 7 an unilaterally projecting upper flap 8, wherein two suspension holes 9 have been punched, to which at a short distance in the direction of the outer edge 11 of the upper flap 8 tear-off perforation slots 12 have been assigned.

Figure 6:
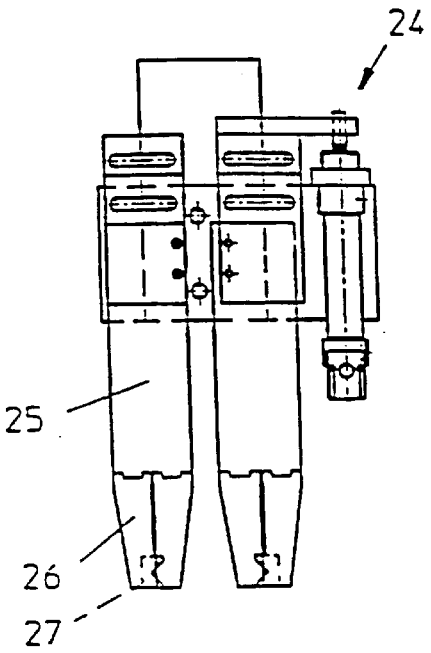
Figure 5:
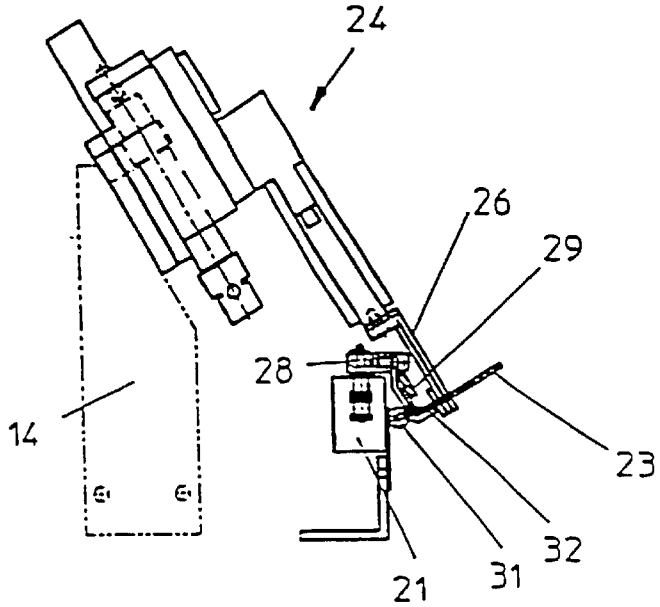
Figure 7:
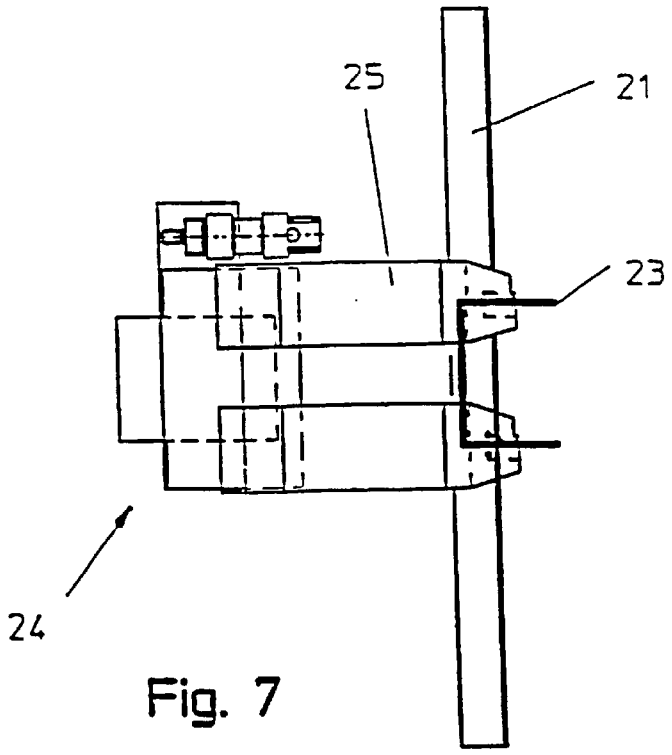

After a bag stack has been formed, on the pin stacking chain 5 the bag stacks 6 are transported to a discharge station 13 located at the end of the pin stacking conveyor 4. In the area of the discharge station 13 a support frame 14 is arranged, which has an upper mounting plate 15, on which a robot 16 with a gripping arm 10 and a grip hand 17 are rigidly mounted. The robot 16 has a total of 6 rotation axes and is capable to remove the closest bag stack 6 from the pin stacking chain 5 by means of the grip hand 17 and to lift it at least to the level of the mounting plate 15 of the support frame 14. On the mounting plate 15 a rotatably driven plate carousel is arranged, which basically has four deflection rollers 18, one of which is being driven and around which a drive belt 19 is guided. On the revolving drive belt 19 holding plates 21 are arranged, on each of them a wire bracket 23 is clampingly held via a clamping element 22 (FIG. 7). While the plate carousel is revolving, the holding plates 21 with the wire brackets 23 reach the area of a locking and straightening unit 24, as closer described in FIGS. 5 to 7, fastened on the mounting plate 15 of the support frame 14. As can be seen especially from FIG. 6, the locking and straightening unit 24 has a prolonged leg 25, which at its frontal end consists of two leg clips 26 with a clamping element 27 arranged on one of the leg clips. The locking and straightening unit 24 can be adjusted via an adjustment mechanism not explained in detail, so that the leg clips 26 traverse the one leg of the wire bracket 23 fastened to the holding plate 21 fir over the clamping element 22. In connection with an additional angled element 28 screwed to the holding plate 21 and a spring element 32 supported against the rod element 31, an additional locking and straightening of the wire bracket 23 is achieved.

Figure 2:
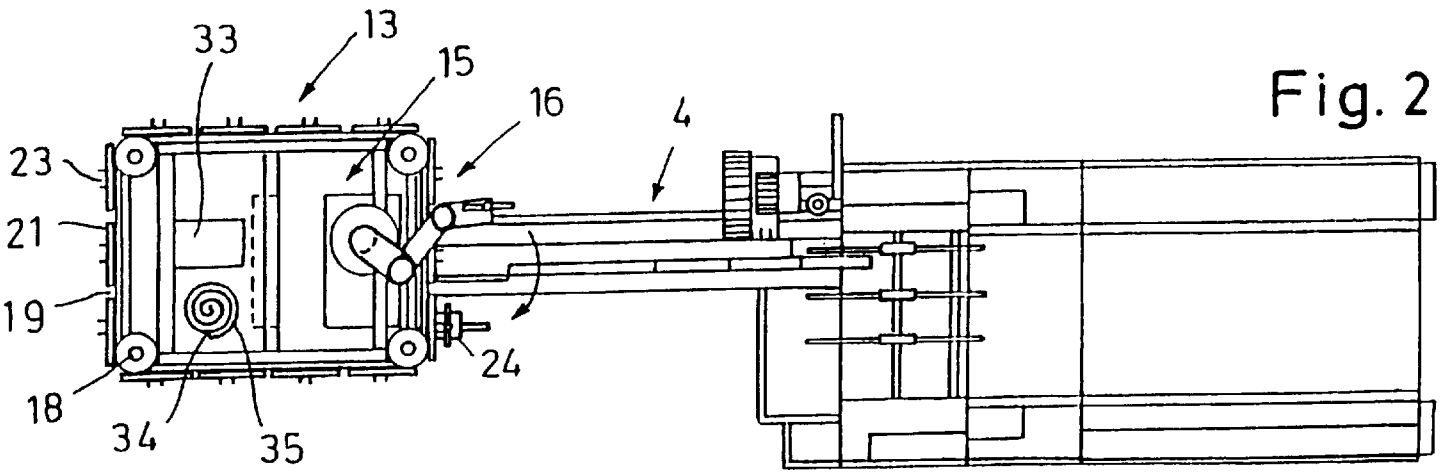

As soon as the wire bracket 23 is fixed this way, the bag stack 6 removed from the pin stacking chain 5 is placed on the projecting legs of the wire bracket 23 via suspension holes 9. To the extent that it is required or desired, prior to the removal of the bag stack 6 also a paper strip, respectively an intermediate paper layer 33 can be inserted in the locking and straightening unit 24. A supply container for such intermediate paper layers 33 can be for instance mounted on the mounting plate 15 of the support frame 14, as shown in FIG. 2. The intermediate paper layer can of course also be arranged laterally next to the support frame 14. After the bag stack 6 has been impaled on the settled wire bracket 23, again, if required, a paper strip, respectively an intermediate paper layer 33 and finally a safety plate 34 in the form of a rubber stopper or the like are applied. These rubber stoppers 34 are for instance stored in a spiral-shaped vibratory hopper 35, namely also on the mounting plate 15 or next to it. Within the framework of a quality control, the bag package interlocked this way with the wire brackets and the applied safety plates, which are again pressed together by the operator, are examined as to the correct position of each bag and than carried away either manually of via the grip hand 17 of the robot 16 and packaged for instance in a cardboard box.

Figure 9:
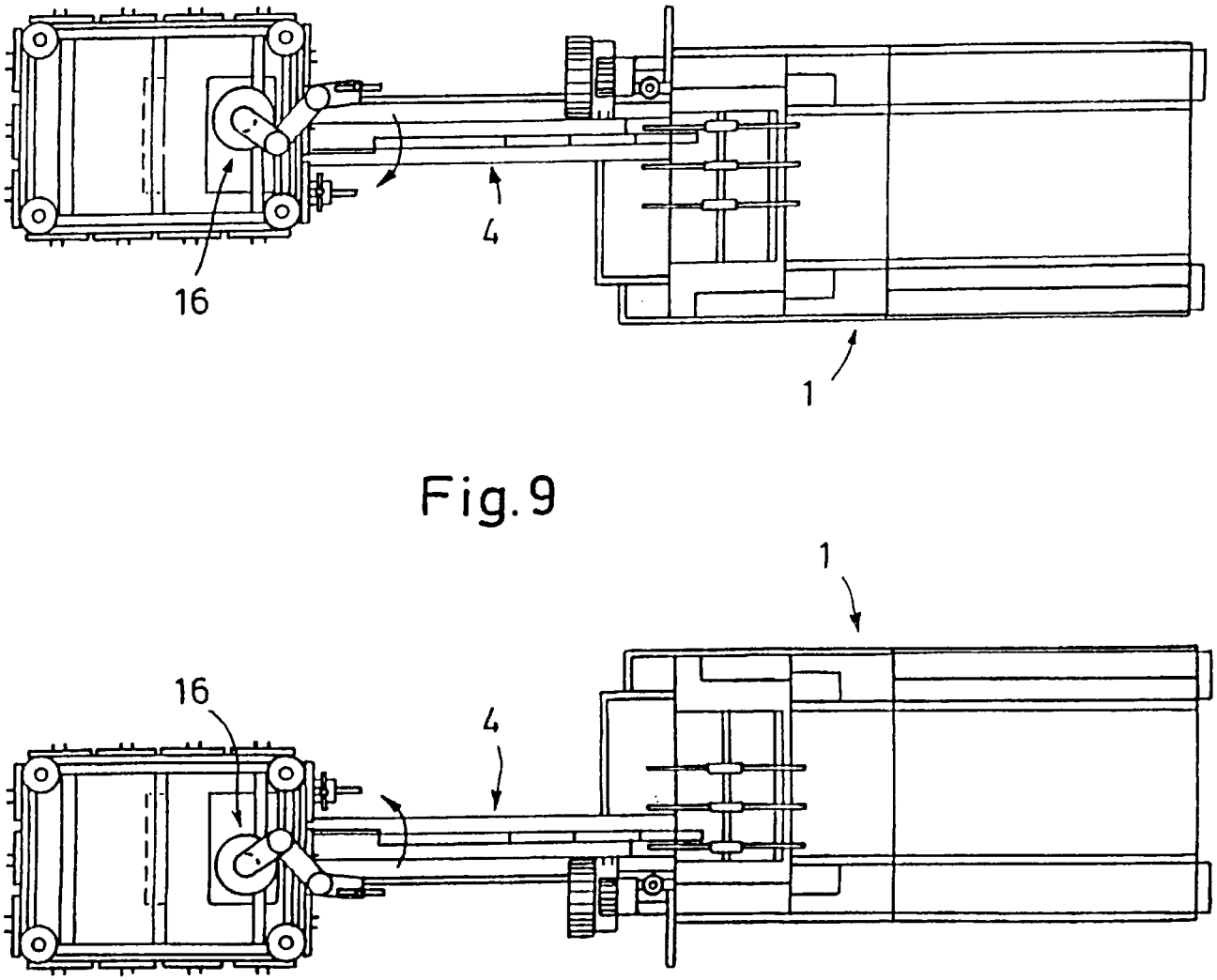
Figure 10:
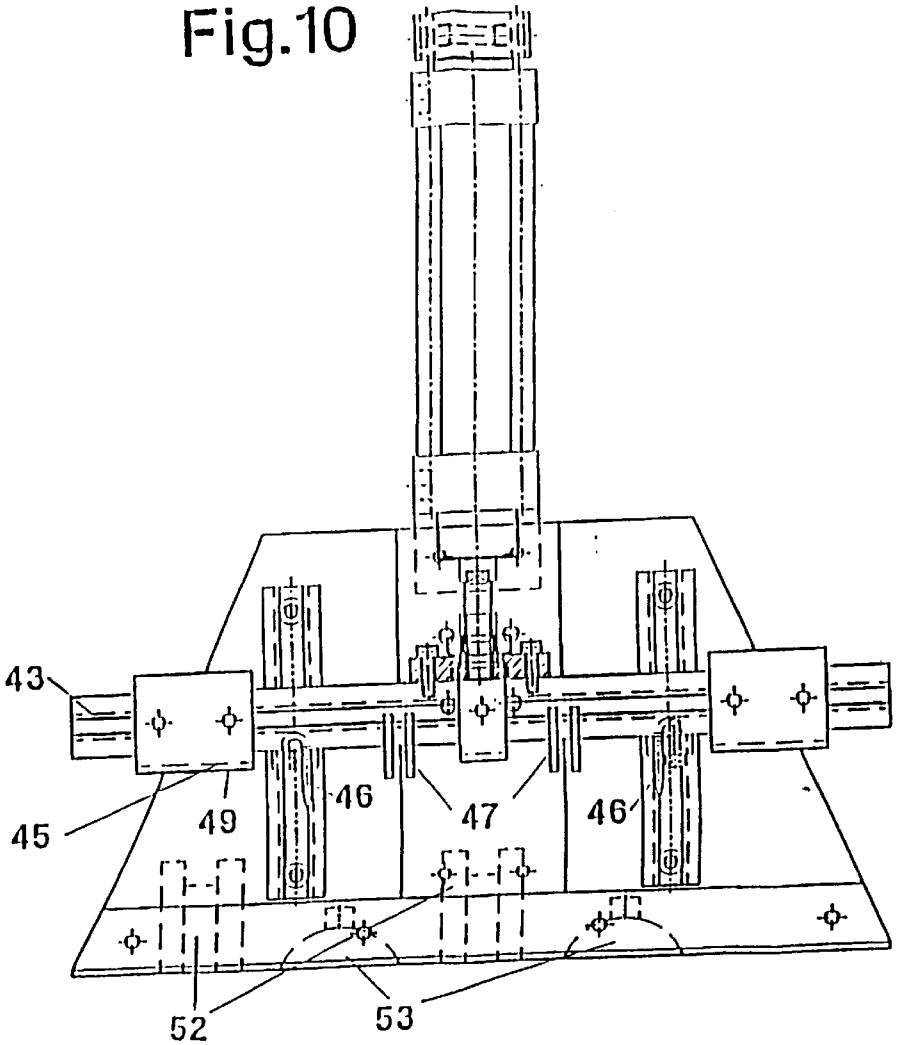
Figure 11:
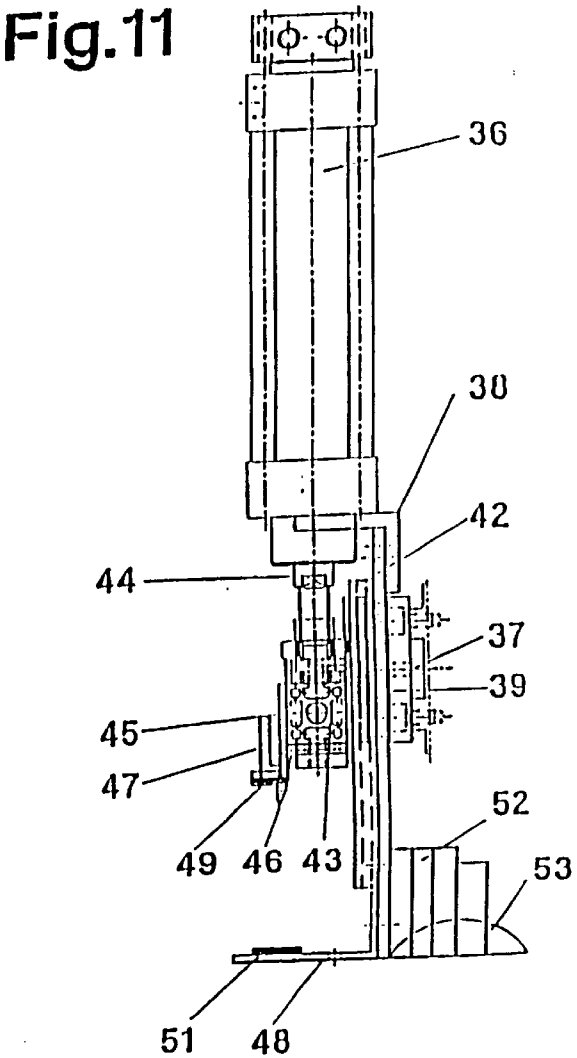

In the robot arrangement according to the invention, the order in which the machines are arranged is not very important, i.e. besides one machine, it is also possible for one operator to serve two identical machines or two machines arranged in a mirror-image manner, as shown schematically in FIGS. 8 and 9.

Figure 13:
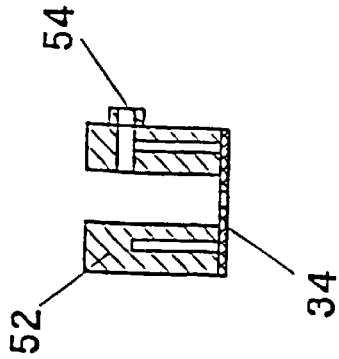
Figure 12:
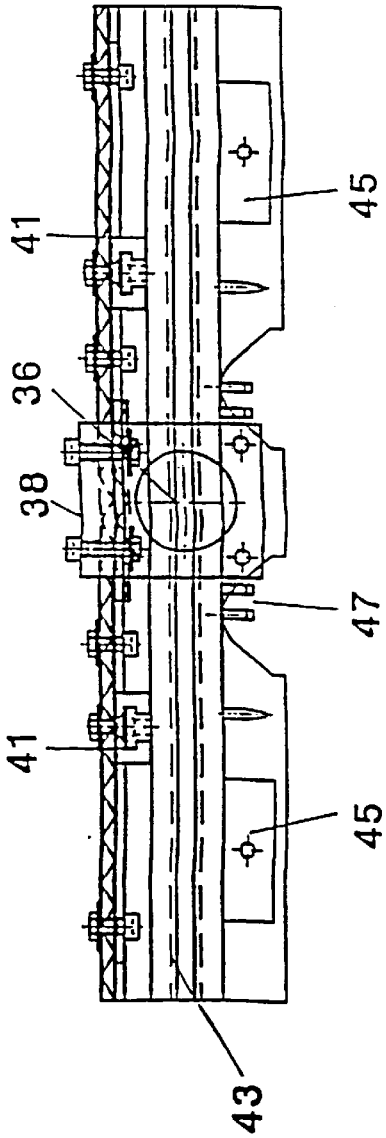

In order to meet these requirements as best as possible, the design of the grip hand 17 of the robot is decisive. In FIGS. 10 to 13, the tong-like grip arm in the form of a multifunctional hand 17 is represented in detail. The multifunctional hand is actuated by a cylinder-piston unit 36, which is swingably supported at 37 on the outrigger of the robot 16. The cylinder-piston unit 36 rests on an angled piece 38, on which a substantially trapezoidal mounting plate 39 is fastened. The mounting plate 39 made preferably of sandwich aluminum has in its frontal area two spaced-apart guide bars 41, wherein a crossbeam 43 is axially displaceably supported via a guide element 42. The crossbeam 43 has a cross section profile of multiple T-shaped grooves. In the individual profile grooves, on the one hand the guide element 42, and on the other hand a ram 44 of the cylinder-piston unit 36 are located, further on the frontal side one or two L-shaped clamping bars 45 and on the underside angled catch pins 46, the distance between them corresponding to the distance between the suspension holes 9 in the plastic bags 2. Finally on the multifunctional hand 17 also wire bracket holders 47 can be provided, whose purpose will be further described. In cooperation with the upper clamping bar 45, a lower clamping bar 48 is fastened to the lower end of the mounting plate 39. Both clamping bars can be provided with a plastic lining 49, 51. On the rear side of the mounting plate, two suction cups 52 are arranged in pairs for handling the above-mentioned safety plates 34, as well as two suction funnels 53 for the above-mentioned paper strips, respectively intermediate paper layers 33. As indicated in FIG. 13, the suction cups 52 are connected via a channel system 54 with a negative pressure source not shown in the drawing. The same applies also to the suction funnels 53. Alternately, the two suction cups 52 can perform both functions.

The multifunctional hand 17 of the robot 16 works in detail as follows: In order to receive paper strips, respectively intermediate paper layers 33, the multifunctional hand 17 is brought into the corresponding position by means of the robot control, so that after suction air is applied in the suction funnels 53, from the paper storage an intermediate paper layer can be removed. The intermediate paper layer is then placed on a wire bracket 23 held in the correct position. For this purpose the suction funnels 53 are shortly impacted with blowing air. Afterwards a bag stack is removed from the pin stacking conveyor 4 and suspended from the wire bracket held in the locking and straightening device 24. After that a further paper strip, respectively intermediate paper layer 33 is again taken up by the robot, respectively by its multifunctional hand, and placed on the wire bracket 23. Finally by means of the suction cups the safety plates, respectively rubber stoppers 34 are taken up either separately or in pairs and pressed onto the free legs of the wire bracket 23. In the next position of the transport carousel, the bag package is examined by the operator, corrected if required, and manually removed from the holder, whereby the rubber stoppers are again firmly pressed on and finally the bag package is deposited in a box. If necessary, it is also possible to provide an automated discharge by the robot.

Figure 14:
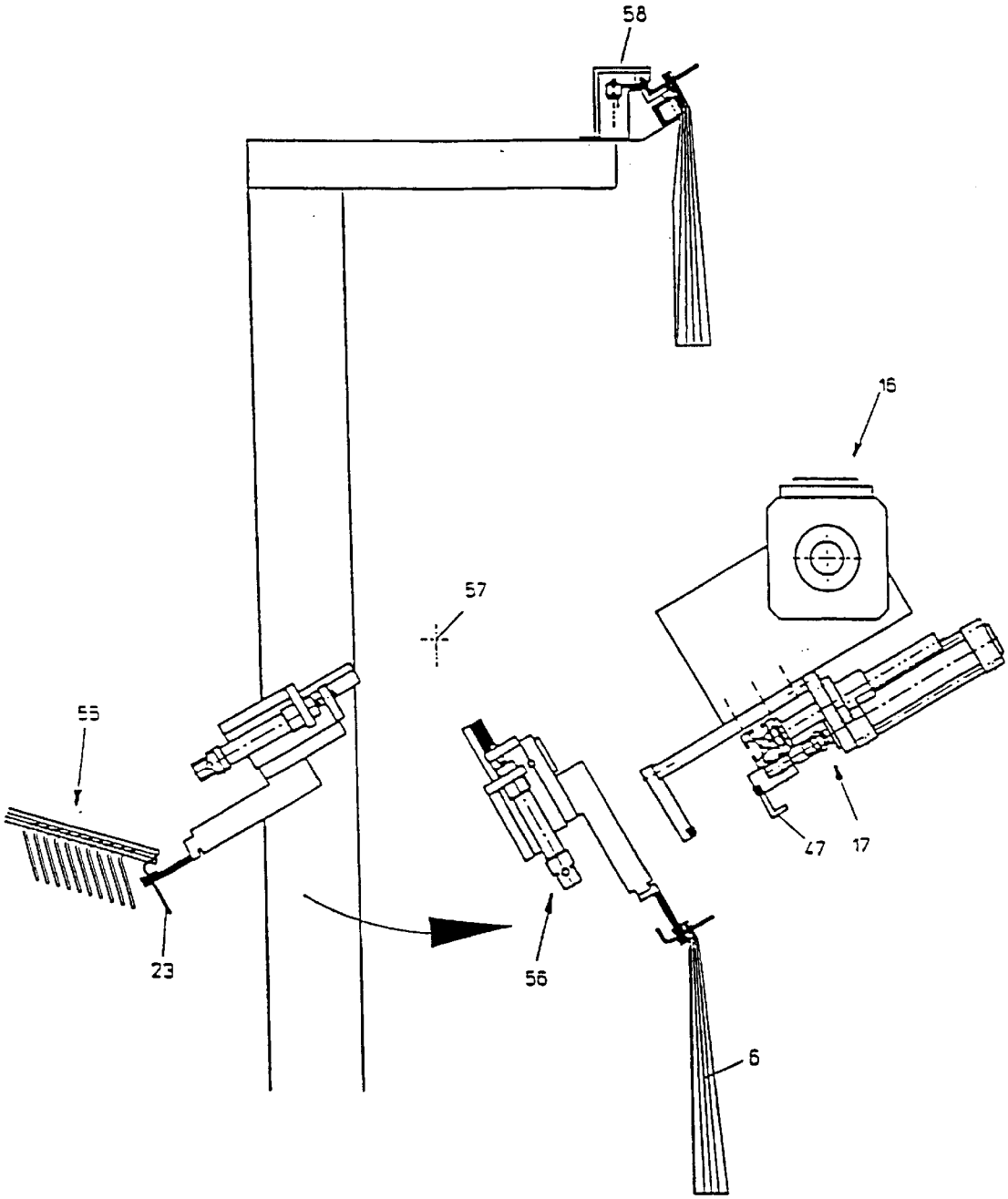
Figure 15:
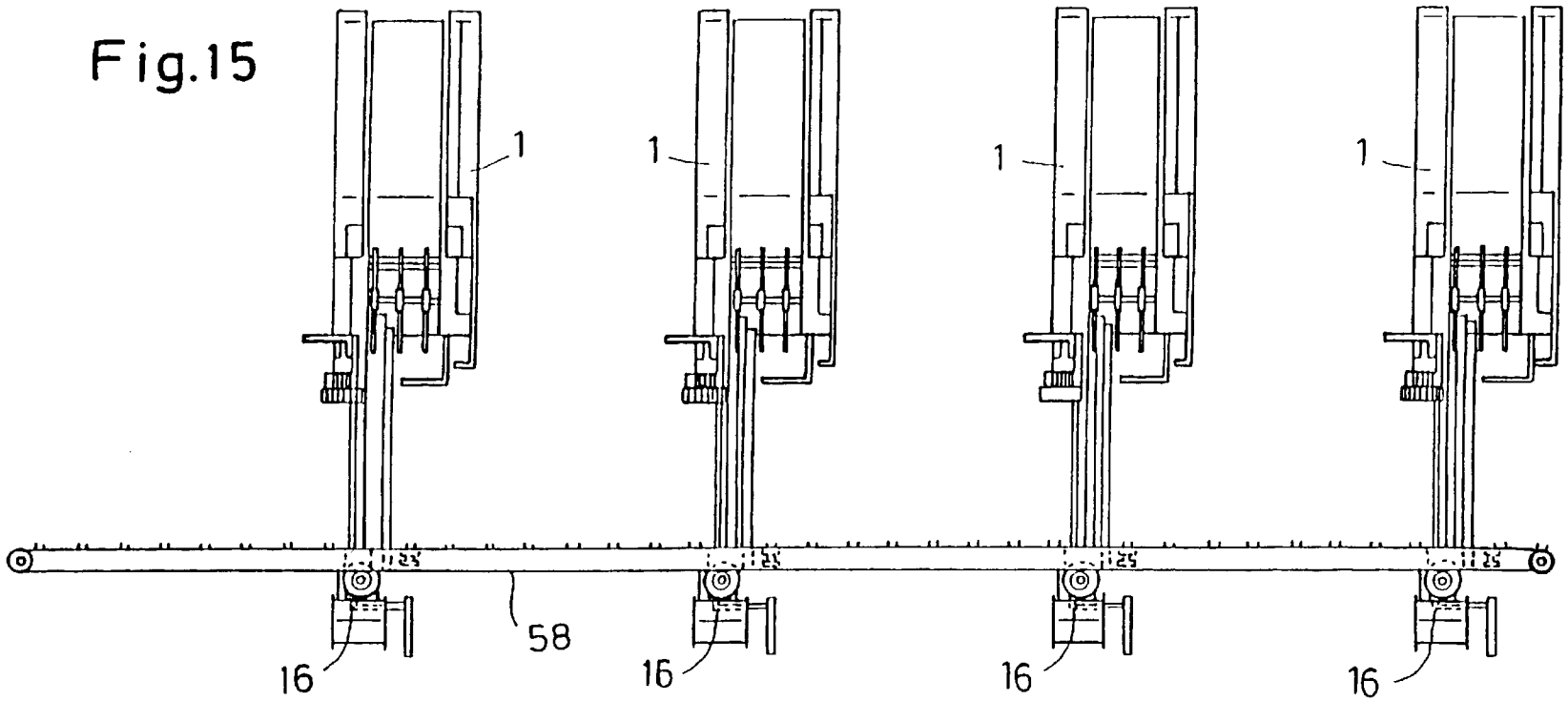
Figure 16:
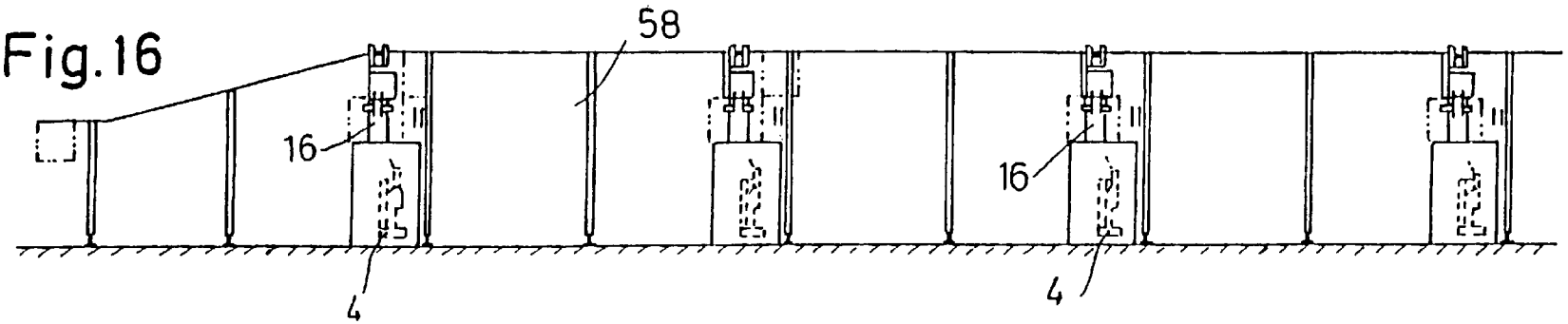

In the FIGS. 14 to 16, an arrangement is shown which is different from the aforedescribed embodiment example in the sense that here the wire brackets 23 are lodged in a bracket magazine 55, which is not closer described. Between the bracket magazine 55 and the robot 16, a straightening and feeding tong 56 is arranged, which is pivotally supported about a point indicated at 57. By means of this straightening and feeding tong, wire brackets 23 can be removed from a bracket magazine 55 and brought into such a position that with the assistance of the mutifunctional hand 17 of the robot 16 a bag stack 6 can be slipped onto the prepared wire bracket 23. After this is done, the wire bracket is released from the feeding and straightening tong 56, and with the aid of the robot 16 is transferred to an elevated transport belt in the form of an elevated transport chain 58. This way it is possible without further ado to arrange several machines, for instance four machines one after the other, as shown in FIG. 15, having a common transport belt 58. Each machine is equipped with its own robot 16 and each machine has its own bracket magazine. Thereby each bracket magazine has a feeding, straightening and locking tong 56 which fits the width of the brackets. In order to keep the transfer and further transport of the wire brackets trouble-free, the already mentioned wire bracket holders 47 are provided on the multifunctional hand.

Figure 17:
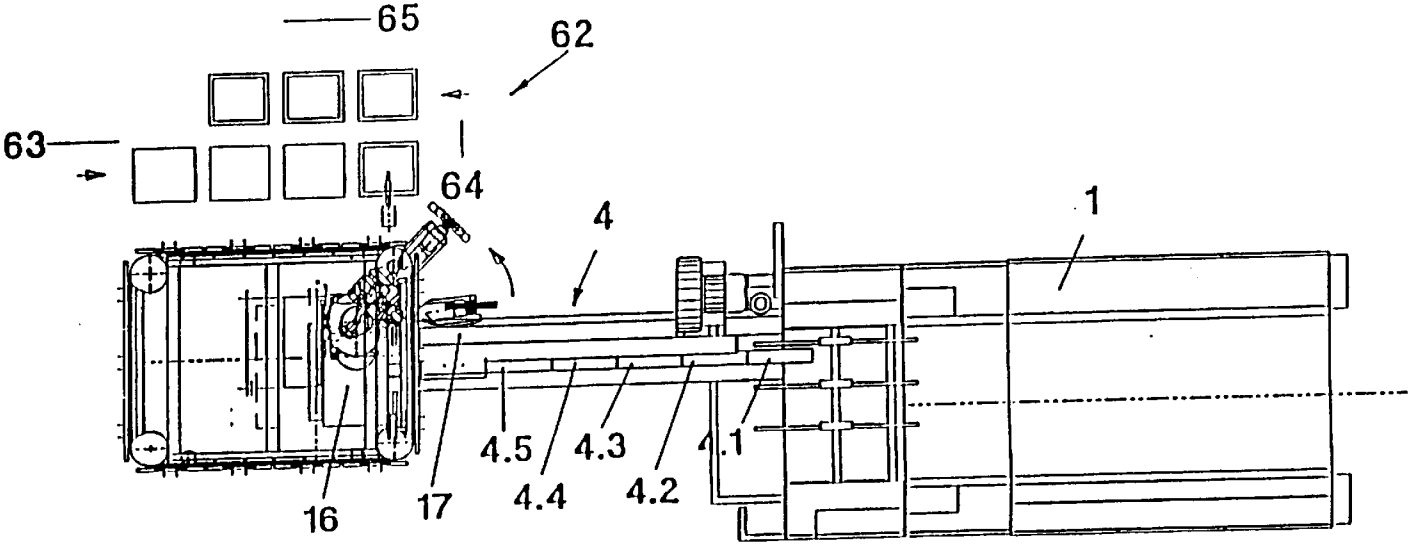
Figure 18:
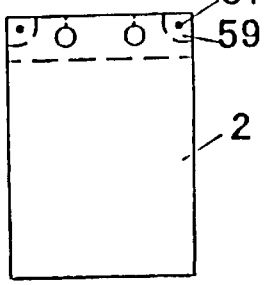
Figure 19:
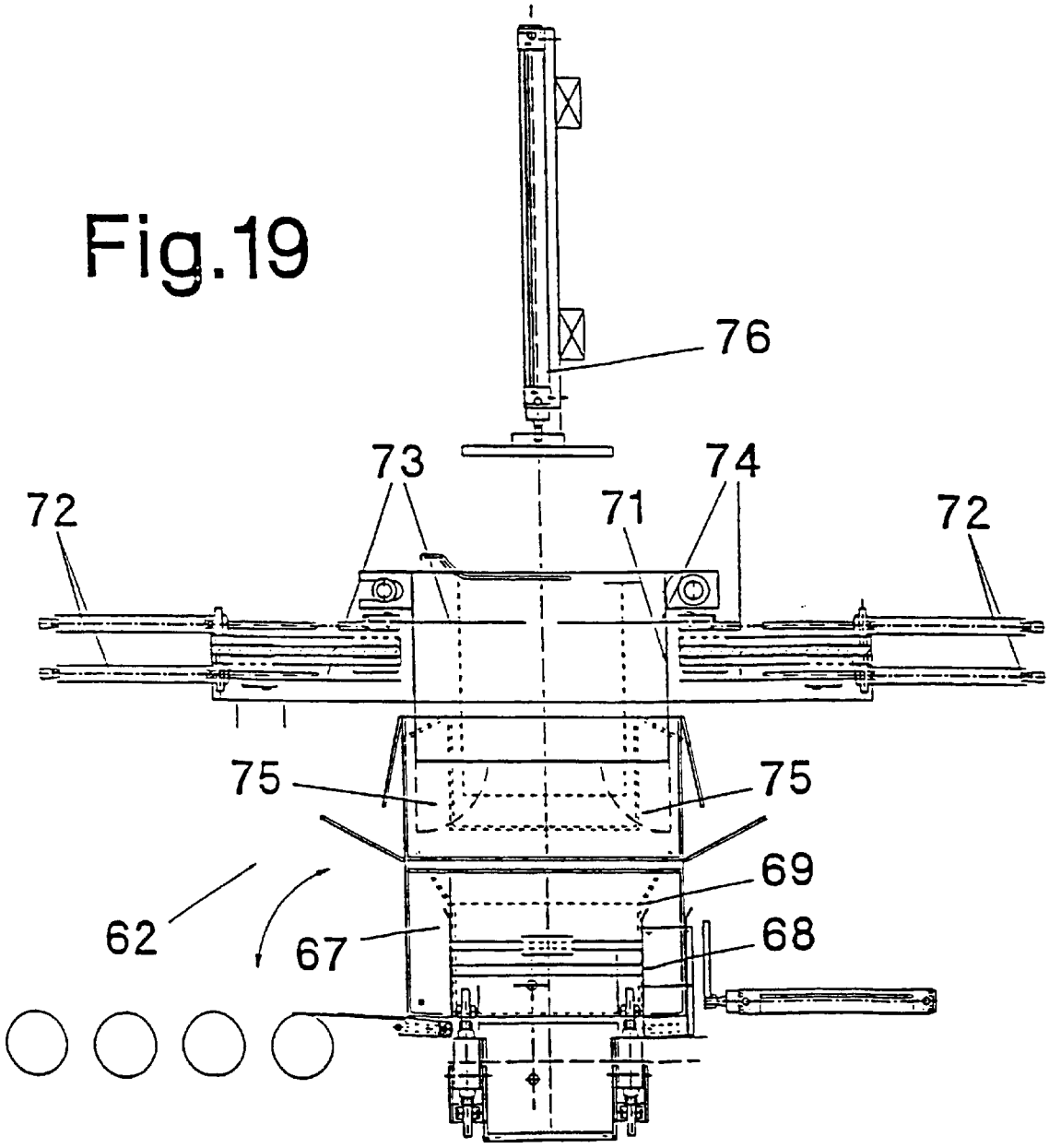

When the interlocking by means of wire brackets 23 is supposed to be eliminated, then another method is used. In this case the bag stacks 6 are interlocked already within the range of the pin stacking conveyor 4 in a further described manner. The bag stacks interlocked this way can be deposited in a cardboard box by means of the robot 16. This method is closer described with the aid of FIGS. 17 to 19. In the station 4.1 of the pin stacking conveyor 4 the bag stacking takes place in the known manner. In the station 4.2 the interlocking of the stacked bags into bag stacks is performed by means of an interlocking device known per se through fusion. A configuration as shown in FIG. 18 can for instance be used for interlocking. By means of glow plugs the interlocking of the bag stack is performed in a perforated marginal area 59, more precise in the area of a preferably prepunched hole 61. In the stations 4.3, 4.4, 4.5 either a manual or an automated quality control takes place, whose details are here of no interest. It is decisive that after the quality control, by means of the multifunctional hand 17 of the robot 16, the bag package is removed from the pin stacking conveyor 4 and finally brought to a discharge station, respectively a boxing station 62. There by means of the robot 16 the respective bag package is deposited in a box 69, which—as indicated by the arrow 63—is moved from the left to the right until it reaches the actual delivery position, whereafter the box is displaced in the direction of the arrow 64 and finally brought into a delivery position in the direction of arrow 65. The discharge of the bag stack is shown in detail in FIG. 19. It can be seen that the box station 62 has a height-adjustable lifting table 66. Furthermore laterally adjustable support wall 67, 68 are part thereof, which can function as hinges at least on one side, so that the empty boxes can be slid into the discharge station. Due to the adjustable support walls 67, 68, the device can be adjusted to the various sizes of the boxes 69. In the upper area of the box station 62, a filling chute 71 is provided, wherein by means of schematically shown displacement mechanisms 72, partitions 73, 74 can be slid from the side into the filling chute 71, and again extracted therefrom. The inserted position is represented with the aid of the upper partitions 73, 74, while the extracted position of the upper partitions 73, 74 is shown in the lower position. The partitions have the task to insure that during the filling of the bag stacks, the drop distance is not too big. For the same purpose the box can be raised via the lifting table 66, as indicated in broken lines. Finally at the lower end of the filling chute 71, it is also possible to provide release flaps 75, in order to further simplify the emptying of the chute. The arrow 76 indicates a compression ram, which presses the bags downwards in order to remove possible air lodged between the individual bags, thereby insuring a perfect packaging of the bag stack 6 in the box 69.

Figures 20, 21:
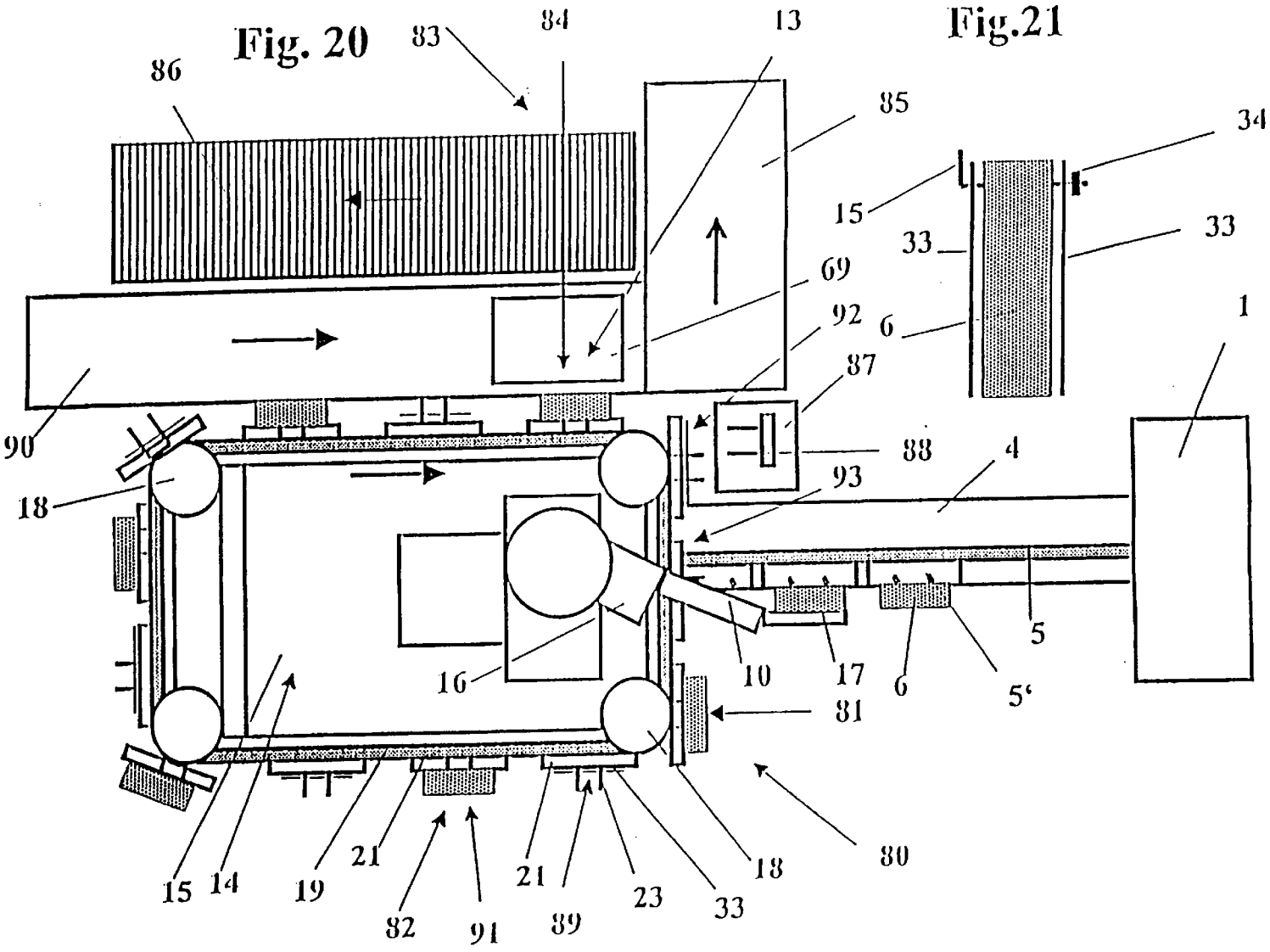

In the illustration of FIG. 20, the collection device has a filling station 80 with a receiving position 81, as well as control and/or service station 82, and finally the discharge, respectively removal station 13 on the opposite side of the drive belt 19.

In the area of the removal station 13, a packaging device 83 with a bag stack removal position 84, corresponding to the above-described boxing station 62, is arranged. On a feeding table 90 the packaged units, such the boxes 69, can be supplied. Along an intermediate table 85, the boxes filled with bag stacks can be carried away over a roller table 86. Between the packaging station 83 and the pin stacking conveyor 4 a separate suspension device 87 is arranged, which has a receiving stand 88 on which bag stacks not produced in an orderly manner can be suspended by means of the robot 16. For this purpose the robot can be controlled by a control device not shown in the drawing of the pin stacking conveyor, for instance by a light barrier/photoelectric cell or the like.

A bag stack 6 of the here-described kind is represented in detail in FIG. 21. It consists of the actual bag stack 6, which in turn consists of a multitude of separate plastic bags, as well as of the inner intermediate layer 33 and the outer intermediate layer 33. The aforementioned parts are kept together by the already mentioned wire brackets 23 and finally also by rubber stoppers 34 or the like. In principle the bag stacks can also consist of interlocked bags, as known per se. In this case the wire bracket serves merely as a transport element.

The device shown in FIG. 20 works as follows:

The robot 16 equipped for instance with a total of six axes of rotation is capable to remove a bag stack 6 by means of the multifunctional hand 17 from the stacking pins 5' of the pin stacking chain 5, and to move this bag stack into the receiving position 81 of the filling station 80. There the bag stack is suspended in stacking plate 21 equipped with a wire bracket 23, in a manner with is closer described further down. In order to facilitate the removal of a suspended bag stack from the pin stacking conveyor, an upwards swinging flap can be provided in this area, so that the bag stack can be removed in a substantially horizontal position. In a start position 89 of the control and/or service station 82, which follows the receiving position 81 in a timed step, at the beginning of a work cycle at first a wire bracket 23 is suspended in the holding element of the stacking plate 21 in this position at the time and at the same time the inner intermediate layer 33 is placed on the wire bracket. Then the revolving chain 19 is automatically moved further in a double timed step. As a result the aforedescribed bag stack in the receiving position 81 has reached a finishing position 91 of the control and/or service unit 82 where the operator applies the outer intermediate layer 33 and the rubber plug 34 shown in FIG. 21. While the start position 89 shows a prepared stacking plate 21, from the finishing position 91 which follows in a single timed step, a finished stacking plate can be seen. After a new bag stack is taken up by the pin stacking conveyor 4, the prepared stacking plate and the finished stacking plate reach the bag removal position 84 of the removal station 13 alternately in succession one after the other where the respective finished bag stacks are removed by the grip arm 10, respectively the multifunctional hand 17 of the robot 16 and deposited for instance in the box 69. The following empty stacking plate of the bag receiving position 84, which in a single timed step is preceded by a prepared stacking plate 21 in an intermediate station 92, is then moved in double timed step until it reaches a middle empty position 93 in the area of the pin stacking conveyor 4, in order to be again in the start position 89 after the following double timed step.

It is self-understood that the invention is not limited only to the illustrated embodiment examples, but also allows for modification within the claims, so for instance it is possible without further ado to use the robot according to the invention also in other types of machines, such as for instance machines for shirt-carrying bags, which also produce bag packages and have to be subsequently packaged. Further the deflection rolls of the plate carousel can be replaced by a wheel-shaped or circular plate.

What is claimed is:

1. An apparatus for producing bags and delivering bags in stacks, said apparatus comprising:

a bag-making machine having a crosscut-welding station for welding seams in a double-layer plastic foil web and separating plastic bags therefrom, and a stamping station for producing stacking holes in said plastic bags;

a pin stacking conveyor having a pin stacking chain movable in steps along said bag-making machine whereby stacks of said bags are formed on respective pairs of pins of said chain and said stacks are carried by said chain to an end of said pin stacking conveyor;

a single six-axis robot located at said end of said pin stacking conveyor and having a program-controlled multifunctional gripper hand and controlled as a function of movements of said pin stacking chain for all manipulations of each bag stack at said end of said conveyor; and a bracket-fixing and bracket-straightening device located within a range of motion of said hand for orienting wire brackets adapted to engage in holes of said bags, said gripper hand engaging said stacks and inserting the brackets into holes of said stacks and removing said stacks from said conveyor for subsequent packaging of said stacks with respective brackets engaged therein.

2. The apparatus defined in claim 1 wherein said robot is mounted above a rotation plane of the pin-stacking chain on a support frame located downstream of said conveyor and receiving said bracket-fixing and bracket-straightening device and means for applying safety members to said bracket and paper layers to said stacks.

3. The apparatus defined in claim 1 wherein said multifunctional gripper hand has first and second clamping bars displaceable one toward the other, one of said clamping bars having at a lower end a mounting plate and the other of said clamping bars being fastened on a crossbeam formed with grooves for guide elements mounted on said mounting plate.

4. The apparatus defined in claim 3, further comprising catch pins on said crossbeam angled obliquely forwardly of said hand, said clamping bars having clamping surfaces at least partly provided with an elastic lining.

5. The apparatus defined in claim 4 wherein a holding device operating with negative pressure is provided on a side of said mounting plate for engagement with a safety member applicable to the wire bracket of a stack.

6. The apparatus defined in claim 1, further comprising a bracket magazine for supplying the wire brackets to said device.

7. The apparatus defined in claim 1, further comprising a transport belt for delivering the stacks to a packaging machine.

8. The apparatus defined in claim 1, further comprising a boxing station within a range of motion of said gripper hand for receiving cardboard boxes in which said hand deposits said stacks.

9. The apparatus defined in claim 1 wherein a collection device is provided within a range of motion of said gripper hand and includes a timed-revolving drive belt on which spaced-apart stacking plates each with a holding element, are fastened.

10. The apparatus defined in claim 9 wherein said drive belt is guided about guide rollers located at corners of a rectangle.

11. The apparatus defined in claim 1, further comprising a photoelectric unit on said pin-stacking conveyor for examination of finished bag stacks.

* * * * *